United States Patent [19]

Casagrande

[11] 4,174,788

[45] Nov. 20, 1979

[54] BATCHING PLANT FOR LIME CONCRETE

[75] Inventor: Bruno Casagrande, Sacile, Italy

[73] Assignee: Casagrande & C. S.p.A., Fontanafredda, Italy

[21] Appl. No.: 837,214

[22] Filed: Sep. 27, 1977

[30] Foreign Application Priority Data

Oct. 4, 1976 [IT] Italy ..... 83451 A/76
Feb. 7, 1977 [IT] Italy ..... 83323 A/77

[51] Int. Cl.[2] ..... F04B 7/00; F04B 15/02

[52] U.S. Cl. ..... 222/630; 222/217; 222/235; 222/278; 417/343; 417/516; 417/900

[58] Field of Search ..... 417/339, 343, 347, 516, 417/900; 222/194, 217, 225, 227, 235, 238, 254, 278

[56] References Cited

U.S. PATENT DOCUMENTS

| | | | |
|---|---|---|---|
| 1,458,979 | 6/1923 | Howe et al. | 222/235 |
| 2,299,565 | 10/1942 | Colburn | 222/227 X |
| 2,549,851 | 4/1951 | Pope | 222/235 X |
| 3,331,332 | 7/1967 | Wennberg | 417/339 X |
| 3,663,129 | 5/1972 | Antosh | 417/900 X |
| 3,682,575 | 8/1972 | Guddal et al. | 417/900 X |
| 3,908,865 | 9/1975 | Day | 417/900 X |

FOREIGN PATENT DOCUMENTS

| | | | |
|---|---|---|---|
| 2,052,583 | 5/1972 | Fed. Rep. of Germany | 417/900 |

*Primary Examiner*—David A. Scherbel
*Attorney, Agent, or Firm*—Stevens, Davis, Miller & Mosher

[57] ABSTRACT

A batching pump for lime concrete comprising a base, a longitudinal displacement feeder attached to said base, at least one evacuator conduit attached to said base, at least one cylinder for receiving at one end thereof lime concrete and pumping lime concrete from said cylinder from said same end to said conduit, pivotal structure to pivotally move said cylinder between said feeder and said conduit, and conduits to feed pressurized gaseous fluid to said cylinder.

6 Claims, 6 Drawing Figures

BATCHING PLANT FOR LIME CONCRETE

The present invention relates to a batching pump for lime concrete and more specifically to a pump constituted of at least one cylinder with which the lime concrete is loaded and from which said concrete is put into a delivery conduit. The cylinder is alternately and sequentially connected to the feed and delivery. Casting techniques often make use of a pump that delivers the concrete from the infeed to the point of casting.

Piston pumps are known that are alternatively filled and emptied. Such known pumps are suitable for sufficiently fluid concrete that offers little resistance to the motion of the piston, but unsuitable to pumping dry lime concrete.

The need for pumps suitable for pumping dry lime concrete and in a determined mass is greatly felt in the manufacturing of long poles, for example, those used for electricity lines.

It is known in the construction of lime concrete poles that in order to get the required mechanical characteristics, the right grade of humidity as well as the proper thickness and the compactness of the concrete in the axial and longitudinal directions of the pole are of fundamental importance.

Consequently it is necessary to utilize a lime concrete containing little water and to feed the needed quantity with precision, so as to obtain the required axial and longitudinal distribution before centrifugating the pole. The pumping means available at present are not adapted to satisfy these needs, since they necessitate the use of a too humid lime concrete and they do not guarantee a constant pumping rate.

The principal object of the present invention is to provide a pump for dry lime concrete which can feed predetermined and predeterminable quantities of lime concrete of the desired consistency and prespecified weight of the manufactured parts.

Another object is to construct a simple pump that is easy to maintain.

A further object is to assure the complete expulsion of lime concrete from the pump.

Beside these objects, the invention offers different and numerous advantages, such as the simplicity and reliability of function, the cleanness and the alternate use of the delivery conduits.

These objects and advantages, together with further objects and advantages are met by a feed pump for lime concrete characterized by:

a longitudinal displacement feeding unit, at least one evacuator conduit, at least one chamber means for receiving and pumping, alternately put in communication with the outlet opening of the feeder and the inlet opening of the evacuator conduit.

Feeding means for gaseous fluid under pressure may also be present. The foregoing objects and advantages will become more readily apparent from the following description and accompanying drawings in which.

Figure 1:
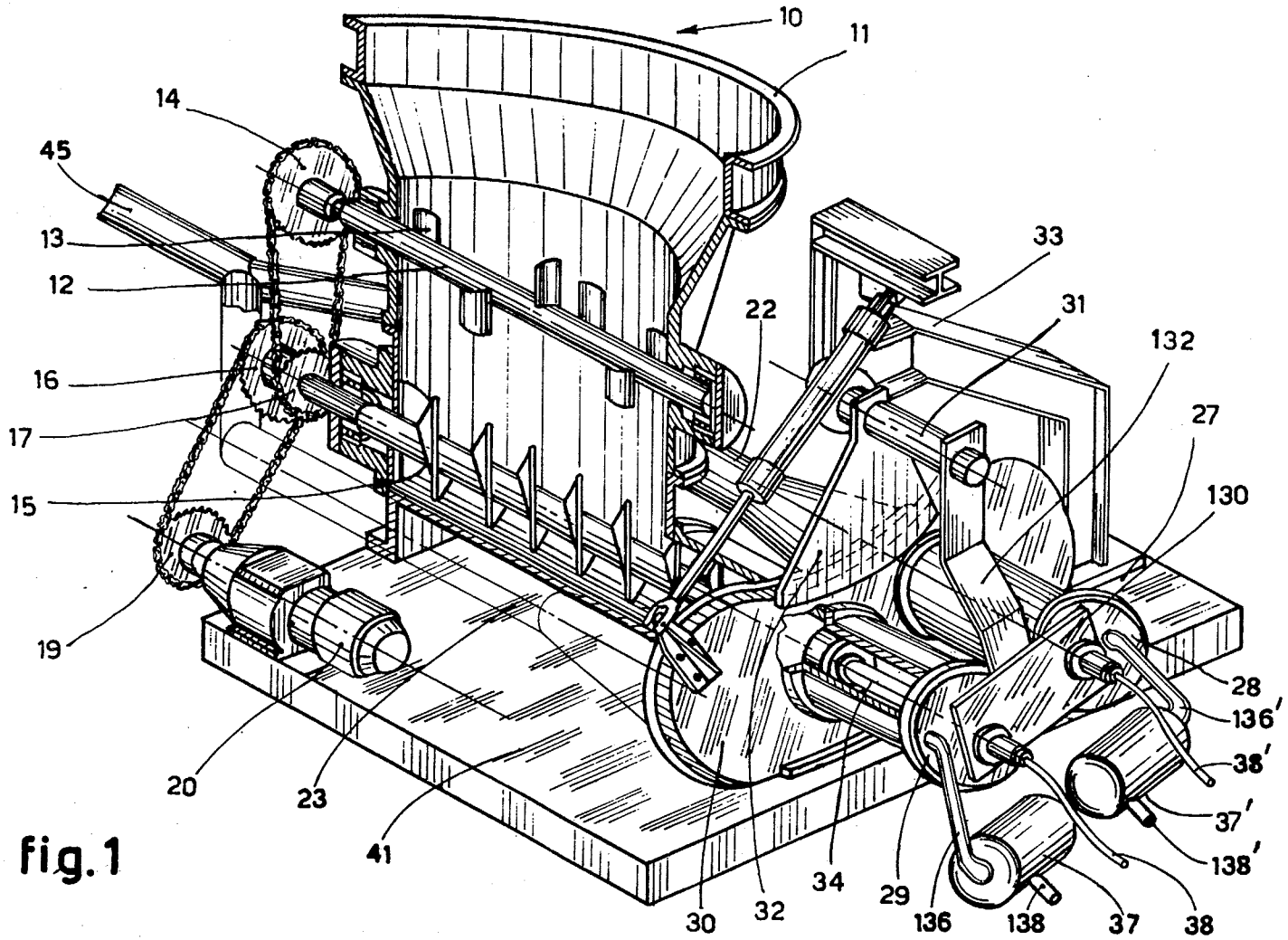
FIG. 1 illustrates a partially sectioned isometric view of the invention.
Figure 2:
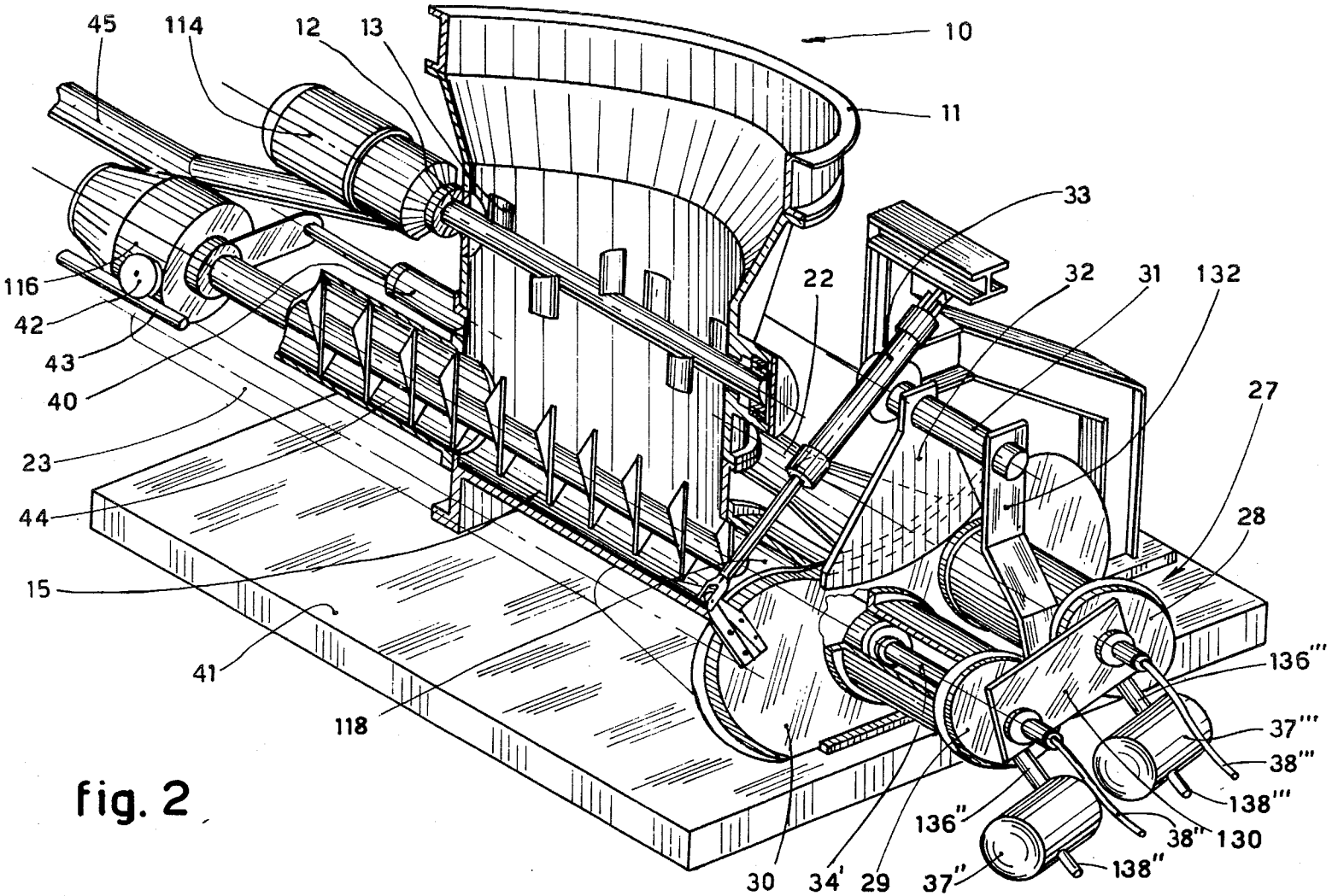
FIG. 2 illustrates a further embodiment of the invention.
Figure 3:
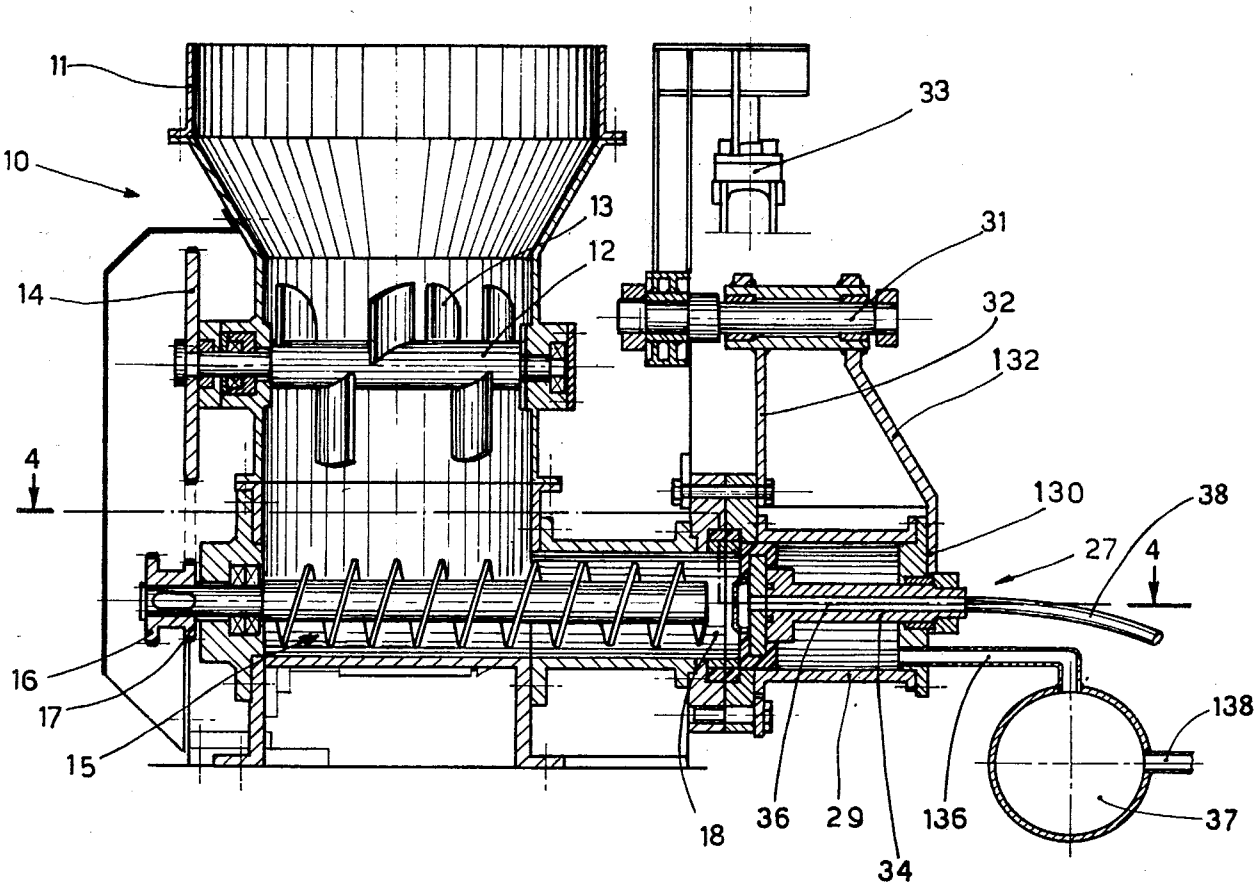
FIG. 3 illustrates a longitudinal sectional view of the invention of FIG. 1.
Figures 4, 6:
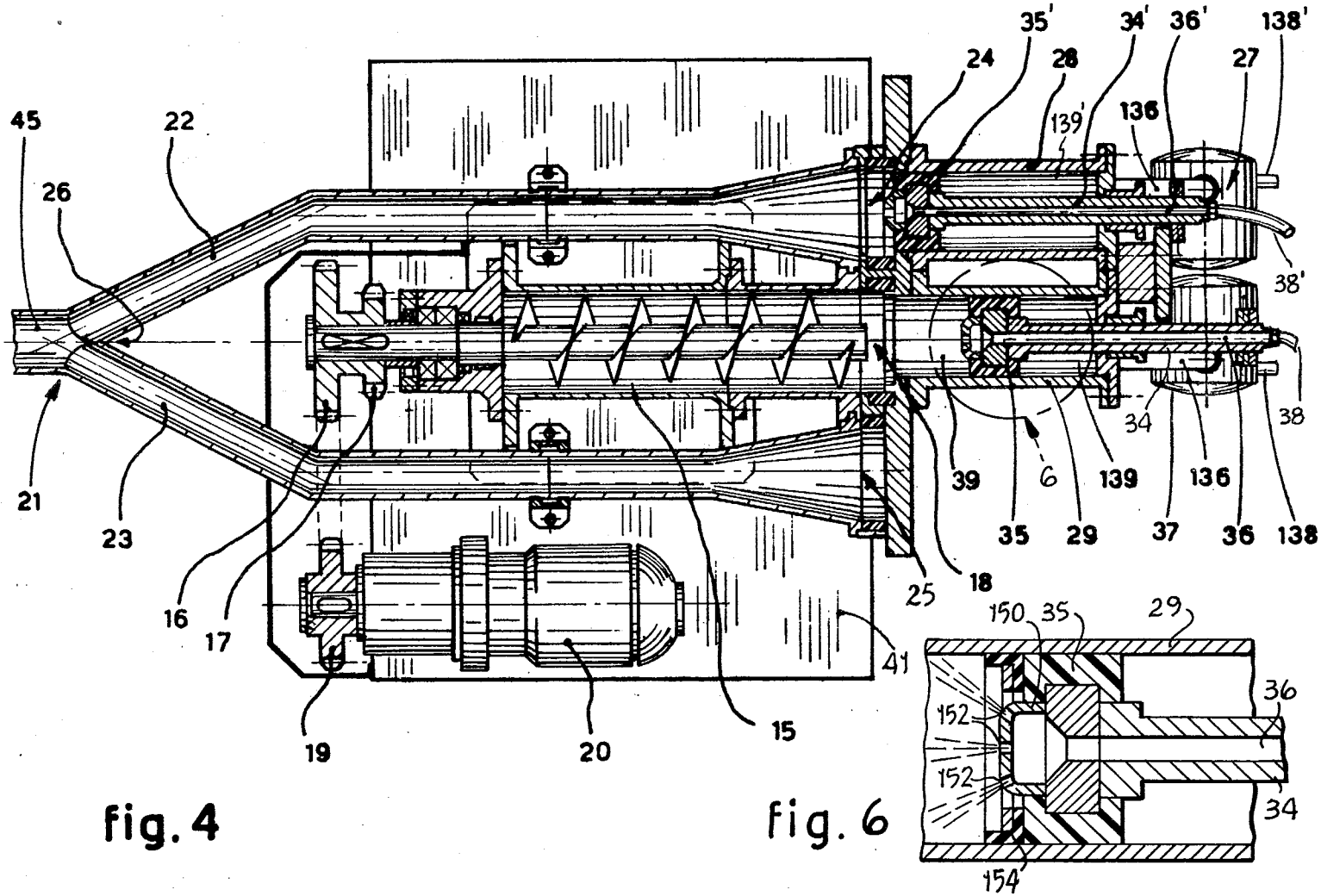
FIG. 4 illustrates a sectional view taken along line 4—4 of FIG. 3.
FIG. 6 is an enlarged detail of that portion of the cylinder 29 and piston 35 which are enclosed by a dot and dash circle labeled "6" in FIG. 4.

In the drawings a feeder 10 substantially constituted of a vertical hopper 11 is provided with a mixer 12 with blades 13. The mixer 12, transversally positioned to the flow of materials through hopper 11 in FIG. 2 is driven directly by a motor 114 but which could be indirectly driven by a toothed wheel 14, toothed wheels 16, 17, 19 and a motor 20. A longitudinal displacment means 15 is placed on the lower part of the hopper 11. The displacement means is either a screw feeder, as in the drawings, or a piston. The longitudinal displacement means 15 is driven directly by a motor 116 or, in the alternative, the longitudinal displacement means is indirectly driven by toothed wheels 16, 17 and 19 and a motor 20. Motor 116 must allow the axial displacement of longitudinal displacement means 15, in the case of the variation of FIG. 2. Motor 116, where the means of axial displacement is constituted of a piston 40, will in turn push on the piston itself with known means of axial motion. Toothed wheel 17 transmits the motion to toothed wheel 14 in the case of the solution of FIG. 1. Outlet opening 18 of hopper 11 is on the same axis as longitudinal displacement means 15 and in an intermediate position between inlet openings 24 and 25 of delivery conduits 22 and 23. The delivery means is generally designated as 21 and comprises two openings 24 and 25 followed by two conduits 22 and 23 respectively which join to form main delivery conduit 45. In FIG. 4 openings 24 and 25 are equidistant from and symmetrical with respect to outlet opening 18 of hopper 11. At the juncture of conduits 22 and 23 there may be an injector 26 which is connected to a source of gaseous fluid under pressure, which is not illustrated in the drawings. Injectors also may be provided for conduits 22 and 23. The chamber means for receiving and pumping the lime concrete is designated generally as 27 and is constituted of oscillating means coaxial with the journal 31 (FIG. 1) and cylinders 28 and 29. Cylinders 28 and 29 each has a chamber 39 or 39′ (not shown) containing piston has fixed thereto a plate 150 having orifices 152 therein (FIG. 6) and a hollow piston rod 34 or 34′ to which inlet 36 or 36′ thereof is connected a delivery means 38 or 38′ thereto for pressurized gaseous fluid. Behind piston 35 or 35′ is chamber 139 or 139′ which is connected through conduit 136 or 136′ to an accumulator tank 37 or 37′ and through conduit 138 or 138′ to a non-illustrated delivery means for pressurized gaseous fluid. The axes of the cylinders 28 and 29 are parallel and equally spaced from the axes of the opening 18 with respect to the deliveries 24 and 25 respectively. Structure 30 carries cylinders 28 and 29 and positions and guides them in their reciprocation generated by the reciprocating means 33. Journal 31 pivots supporting structure 30. Pneumatic or hydraulic piston 35 and the piston rod 34 reciprocate. Pressurized gaseous fluid passes through the piston rod 34 or 34′ and into chamber 39 or 39′ through holes 152 in plate 150 of piston 35 or 35′. Conduits 136 and 136′ conduct fluid to chamber 139 and 139′ and accumulator tanks 37 and 37′. The movement of pressurized gaseous fluid is effected in coordination with the action of the reciprocating means 33 and with the positioning of the chamber 39 or 39′ with respect to the outlet opening 18. Translation means 40 displaces the transport screw 15 to and fro. The translation means are shown in the drawing as a piston symmetrically parallel with respect to the transport screw 15. Base 41 supports the feeder. Toothed wheels 42 run on guides 43 to support and guide motor 116 when it moves longitudinally due to the action of the translation means 40. Chamber 44 contains the longitudinal displacements means.

The apparatus functions as follows:

The constituents of the lime concrete, that is to say, the aggregate, cement and water are mixed to obtain a homogeneous mixture in accordance with known techniques.

The lime concrete, prepared as such, is introduced into the hopper 11 where it is kept in motion or continually mixed by the mixer 12.

The lime concrete in hopper 11 descends into the longitudinal displacement means 15, which drives it axially towards the opening 18. In correspondence with the opening 18 is cylinder 29 so that the lime concrete pushed by the transport screw 15 gradually empties into the chamber 39 while simultaneously pushing back the piston 35 thereby causing the expulsion of the gaseous fluid from chamber 139 until the piston is pushed back to the end of its backward stroke.

The longitudinal displacement means 15 determines the compactness of the lime concrete and ensures the precision of the quantity of lime concrete introduced into chamber 39.

The reciprocating means 33 is actuated, to move the opening of the cylinder 29 until it coincides with the opening 25 of delivery conduit 23. As a result of such movement, the opening of cyliner 28 is connected to the opening 18 of the hopper 11. Cylinder 28 is loaded in the same manner as was cylinder 29.

While cylinder 28 is being loaded, cylinder 29 is being unloaded by injecting pressurized gaseous fluid into the chamber 39 of the cylinder 29 through hollow rod 34. The thrust generated by the pressurized gaseous fluid pushes the lime concrete, present in the chamber 39, from the cylinder 29 into the conduit 23 and hence into general delivery conduit 21. Given the compactness of the lime concrete, the pressurized gaseous fluid pushes it substantially in a block. If part of the lime concrete remains in the chamber 39 it is then expelled by pushing piston 35 by reason of introducing pressurized gaseous fluid into chamber 139 through conduit 136. In this way piston 35 reaches its original loading position and at the same time cleanses cylinder 29.

In this way, a substantially constant quantity of lime concrete is always admitted into the general delivery conduit for each actuation of each of cylinders 28 and 29.

The cycle of emptying and filling each cylinder is repeated until the desired quantity of lime concrete is delivered. The disadvantage of tamping is avoided due to the flow of pressurized gaseous fluid through the injector 26.

Figure 5:
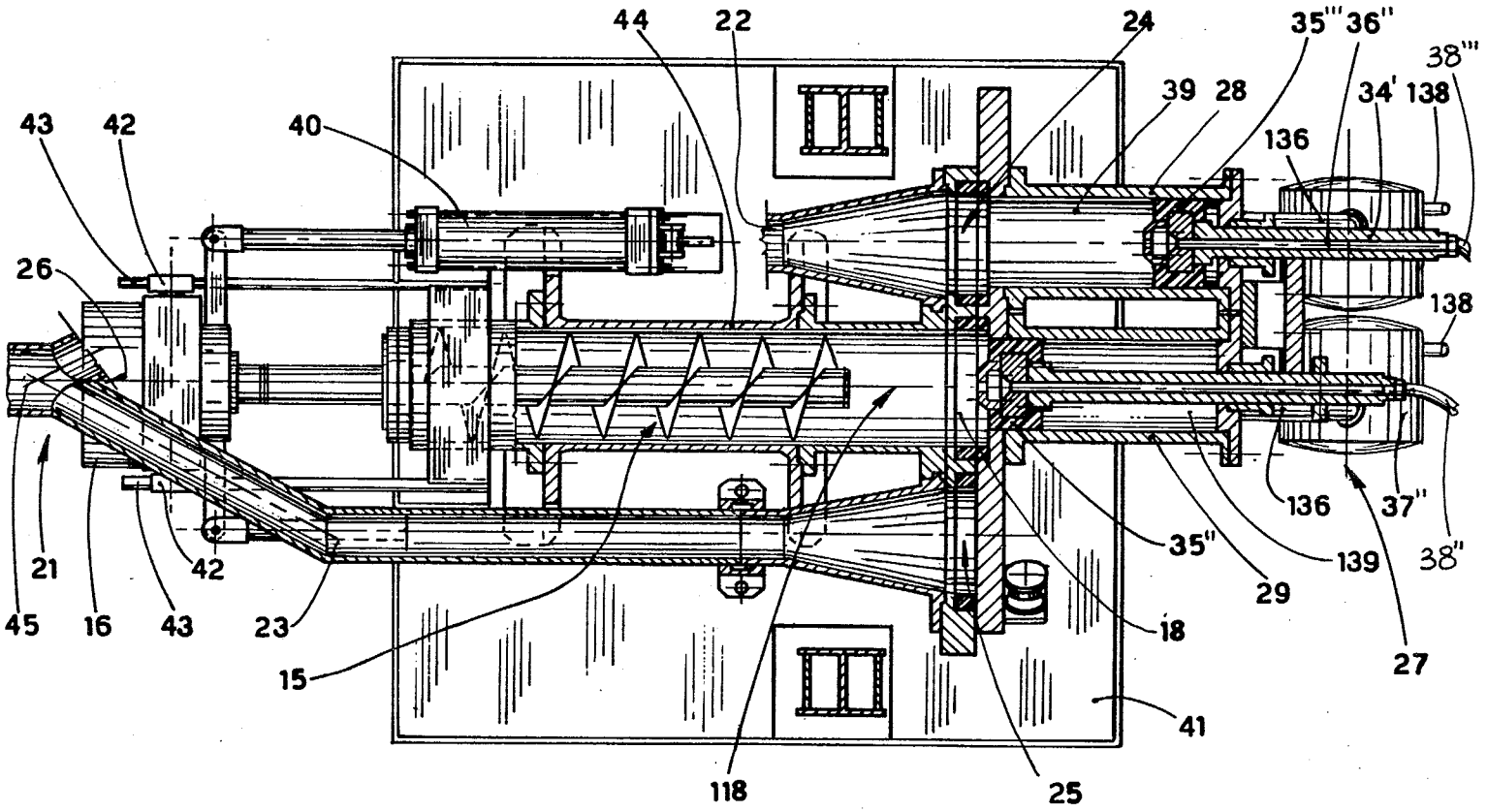
FIG. 5 illustrates a sectional view of FIG. 2 similar to FIG. 4.

In FIGS. 2 and 5 the lime concrete travels down the hopper to the longitudinal displacement means 15 while said means is in the withdrawn position of FIG. 5.

The rotation of displacement means 15 sends the lime concrete into prechamber 118. As prechamber 118 is partially or totally filled, displacement means 15 is thrust forward (to the right) by the translation means 40. When the filled cylinder 29 is replaced by cylinder 28 displacement means 15 is withdrawn.

This double action of rotation and thrust gives the lime concrete better compaction in chamber 39 and hence a more reliable filling with a higher degree of dosage precision. The rest of the cycle is as described before.

Preferential embodiments of the invention have been described herein, but there are many other possible variations for an expert in the art, without going beyond the domain of the inventive data.

It is possible to alter the form and dimensions of some or all of the parts. It is possible to envisage the means 27 with only one chamber for receiving and pumping the lime concrete. It is also possible to envisage the means 27 with more than two chambers for receiving and pumping the lime concrete.

It is possible that mixer 12 is positioned vertically. Instead of the transport screw, a plunger piston or other means of thrust could be employed.

It is also possible to load the quantity of lime concrete by regulating the loading stroke of the cylinders 28 and 29. It is further possible to mount support structure 30 of cylinders 28 and 29 on guides substantially normal to the axis of inlet opening 18 giving a linear translation of said cylinder between opening 18 and openings 24 and 25.

It is possible to equip pistons 35 of cylinders 28 and 29 with wiper rings 154 (FIG. 6) for better displacing the lime concrete stuck to the interior thereby facilitating the sliding of the piston.

It is further possible to mount nozzle means in cylinder 29 connected to the outlet of the piston rod 34 or with another conduit projecting from the piston 35.

The pistons of the cylinder can be driven by mechanical means such as toothed wheels and rack.

Moreover the pressurized gaseous fluid may be air or other gas with the desired humidity.

It is also possible to envisage two longitudinal means having different axes, and frontally to their outlet openings are present evacuator conduits spaced accordingly for inserting and removing the reception chambers.

What is claimed is:

1. A batching pump for lime concrete comprising a base, a longitudinal displacement feeder attached to said base, evacuator conduits attached to said base, said evacuator conduits being placed at least partially parallel to the axis of the feeder, cylinders for receiving at one end thereof lime concrete and pumping lime concrete from said cylinder from said same end to one of said conduits, the number of the cylinders being equal to the number of said evacuator conduits and said cylinders having an interaxial distance substantially equal to the distance between the axis of the feeder and the axis of each of the evacuator conduits, means to pivotally move said cylinder between said feeder and said conduit, and means to feed pressurized gaseous fluid to said cylinder.

2. A batching pump for lime concrete comprising a base, a longitudinal displacement feeder having an outlet attached to said base, evacuator conduits having inlets to receive concrete attached to said base, cylinders for receiving at one end thereof lime concrete and pumping lime concrete from said cylinder from said same end to said conduit, said cylinders for receiving and pumping the lime concrete being symmetrically and radially distributed as to individually mate with the outlet of the feeder and an inlet of said evacuator conduit, the axes of the cylinders being also parallel to the axes of said evacuator conduits, means to pivotally move said cylinders between said feeder and said conduits, and means to feed pressurized gaseous fluid to said cylinders.

3. A batching pump for lime concrete comprising a base, a longitudinal displacement feeder attached to said base, said feeder including a mixer and a longitudinal displacement means, at least one evacuator conduit attached to said base, at least one cylinder for receiving at one end thereof lime concrete and pumping lime concrete from said cylinder from said same end to said conduit, the axis of the cylinder being also parallel to the axis of said evacuator conduit, means to pivotally move said cylinder between said feeder and said conduit, and means to feed pressurized gaseous fluid to said cylinder.

4. A batching pump for lime concrete comprising a base, a longitudinal displacement feeder attached to said base, said longitudinal displacement feeder being axially displaceable, at least one evacuator conduit attached to said base, at least one cylinder for receiving at one end thereof lime concrete and pumping lime concrete from said cylinder from said same end to said conduit, the axis of the cylinder being also parallel to the axis of said evacuator conduit, means to pivotally move said cylinder between said feeder and said conduit, and means to feed pressurized gaseous fluid to said cylinder.

5. A batching pump for lime concrete comprising a base, a longitudinal displacement feeder attached to said base, at least one evacuator conduit attached to said base, at least one cylinder for receiving at one end thereof lime concrete and pumping lime concrete from said cylinder from said same end to said conduit, said cylinder comprising a chamber, an orificed piston within said chamber and a hollow piston rod attached to said piston through which a pressurized gaseous fluid is passed, means to pivotally move said cylinder between said feeder and said conduit, and means to feed pressurized gaseous fluid to said cylinder.

6. The batching pump for lime concrete of claim 5 including wiper rings connected to said piston.

* * * * *